US005167606A

United States Patent [19]

Kuchenbecker

[11] Patent Number: 5,167,606

[45] Date of Patent: Dec. 1, 1992

[54] METHOD OF FORMING A PLY SEPARATION REGION IN A PAPERBOARD BLANK

[75] Inventor: Morris W. Kuchenbecker, Nevada, Wis.

[73] Assignee: James River Corporation of Virginia, Richmond, Va.

[21] Appl. No.: 741,591

[22] Filed: Aug. 7, 1991

Related U.S. Application Data

[62] Division of Ser. No. 636,123, Dec. 31, 1990, Pat. No. 5,076,439.

[51] Int. Cl.[5] ..... B31B 3/25; B31B 1/25

[52] U.S. Cl. ..... 493/160; 493/963

[58] Field of Search ..... 493/59, 60, 61, 160, 493/340, 396, 963

[56] References Cited

U.S. PATENT DOCUMENTS

| | | | |
|---|---|---|---|
| 3,399,820 | 9/1968 | Foster et al. | 229/37 |
| 3,409,206 | 11/1968 | Slovka et al. | 493/963 |
| 3,443,489 | 5/1969 | Watkins | 493/396 |
| 3,580,466 | 5/1971 | Thelen et al. | 229/14 |
| 3,835,754 | 9/1974 | Lewyckyj | 493/963 |
| 4,613,046 | 9/1986 | Kuchenbecker | 206/622 |
| 4,687,104 | 12/1987 | Ielmini | 206/607 |
| 4,740,163 | 4/1988 | Kuchenbecker | 493/370 |
| 4,746,109 | 6/1985 | Bar et al. | 270/95 |
| 4,951,824 | 8/1990 | Kuchenbecker et al. | 206/625 |

*Primary Examiner*—William E. Terrell

*Attorney, Agent, or Firm*—Sixbey, Friedman, Leedom & Ferguson

[57] ABSTRACT

A tear strip is formed in a paperboard container blank by scoring a line of weakness on each of the opposite surfaces. The lines are offset from each other to form between them an area where the piles are easily separated. One or both lines are formed by impressing the blank with a diamond pattern knurling tool.

4 Claims, 7 Drawing Sheets

10
9
13
14
15
16
5
6
33
35
41
42
45
46
52
53
54
57
58
VI
VI a
b
c
d
e
a
5
6
57
58

B'
A

METHOD OF FORMING A PLY SEPARATION REGION IN A PAPERBOARD BLANK

This is a divisional application of Ser. No. 07/636,123 filed Dec. 31, 1990 U.S. Pat. No. 5,076,439.

BACKGROUND OF THE INVENTION

1. Technical Field

The present invention relates to a carton having a barrier construction and a method of making the same which is to be filled with a consumable product accessible through an opening in the carton. More particularly, the invention pertains to a carton which when sealed forms a resistant barrier between the contents thereof and the surrounding environment.

2. Background Art

Paperboard cartons have been manufactured with a variety of constructions and opening features which allow the consumer access to the contents of the carton. Many of these constructions, however, are not concerned with the effects of the environment on the consumable product contained within the final carton. Additionally, the opening features which may consist of perforations, herringbone cuts, adhesive weaknesses, as well as other means of providing a point along the top panel, side panel or hinge lines where the carton may be most readily opened or similarly unconcerned about the detrimental affects of the environment on the contents of the carton.

U.S. Pat. No. 3,399,820 issued to Foster et al. discloses one such opening feature commonly employed in cartons of this type. This opening feature is what is known as a double cut score opening feature which is formed by way of double cut scores; i.e., a pair of inner and outer cuts in the paperboard material with the cuts of each pair running parallel to one another, along a panel of the carton. By so providing these cut score lines, when the consumer applies an upward force or opening force on the tear flap provided between the pairs of cut score lines, ply separation occurs in the region between the inner and outer cut score lines. Continued pulling of the tear causes complete separation of the opening flap to allow the consumer unobstructed assess to the contents of the carton.

Similar opening features are disclosed in U.S. Pat. No. 4,746,109 issued to Prater and U.S. Pat. No. 4,613,046 issued to Kuchenbecker. As in the above-mentioned patent, a point of weakness is provided in a panel of a respective carton where ply separation of the panel is permitted to occur when the consumer applies an opening force to the pull tab. The ply separation occurs between two pairs of reverse cut lines which are formed at least halfway through the panel of the carton area. However, when forming the paperboard blanks which are to be later used and erecting the cartons disclosed, both sides of the paperboard material are cut approximately 50% of the paperboard thickness into the carton. By cutting through both sides of the paperboard carton, the barrier which may have previously existed due to various coatings provided on the paperboard is reduced. By cutting into both sides of the paperboard, there is left only the plies of the paperboard material which are not impervious to moisture and subsequently cannot prevent the leaking of moisture into and out of the carton. Moreover, the construction of the above-mentioned cartons results in the exposure of bare edges of paperboard material within the internal cavity of the erected carton. By presenting such exposed paperboard edges within the cavity of the formed carton will allow wicking to occur as with the double cut score feature which in time could result in contamination of the contents of the container or leakage of the contents from within the container.

U.S. Pat. No. 4,687,104 issued to Ielmini discloses a similar carton construction having double cut scores formed on the inner and outer surfaces of the top and front flaps thereof. Again, as with the previous constructions, by cutting through both sides of the paperboard carton, the barrier which may have previously existed due t the various coatings provided on the paperboard material would be eliminated, thereby resulting in possible contamination of the contents of the carton or leakage of such contents. Additionally, as with the previously mentioned constructions, bare edges of the paperboard material will be exposed within the cavity of the formed carton thereby resulting in the possible contamination or leakage of the contents of the carton.

In an attempt to overcome the shortcomings associated with the above-described carton construction, cartons of the form known in the art has bag-in-a-box type constructions where developed. One such carton is illustrated in U.S. Pat. No. 3,580,466 issued to Thelen et al. wherein a bag formed of a plastic or treated paper material is positioned within the carton prior to its final sealing procedures. The carton may be formed having the double cut score opening feature; however, because the contents are enclosed within the plastic bag within the carton, the contents thereof are not exposed to any environmental affects nor is it possible for the contents of the bag to leak from the carton. However, such construction adds significantly to the cost of the carton, as well as the manufacturing process entailed in forming the final product.

U S. Pat. No. 4,951,824 issued to Kuchenbecker et al. discloses one solution to the aforementioned problem of leaking in the top panel of the formed carton at the region of weakness necessary for forming the opening feature. Therein, the inner line of weakness is formed by way of a crease score line rather than a partially cut score line such that the integrity of the inner surface f the top panel is maintained. However, the overall construction of the carton when erected results in the exposure of bare edges of the carton blank within the inner cavity of the carton. Again, as mentioned above, this may result in the contamination of the contents of the carton or leakage of the contents therefrom.

Therefore, as can be seen from the foregoing, there is clearly a pressing need for a carton of the above-mentioned type which will provide a reliable opening feature that is capable of opening with ease by the consumer, which will resist the infiltration of moisture and will not retard the structural integrity of the carton when opened. Moreover, there is a pressing need for a carton having a construction which does not result in the exposure of bear paperboard edges within the inner cavity of the carton, thus eliminating any potential of leakage of the contents or contamination thereof.

SUMMARY OF THE INVENTION

It is a primary object of the present invention to overcome the aforementioned shortcoming associated with the prior art.

Another object of the present invention is to provide a paperboard carton including a reliable opening feature which is capable of being easily and reliably opened by the consumer without destroying the structural integrity of the carton.

Yet another object of the present invention is to provide a paperboard blank for forming a carton of a high barrier construction for forming a moisture barrier between the contents of the carton and the surrounding environment.

It is yet another object of the present invention to provide a carton of a construction wherein no bare die cut edges are present in the interior of the carton by skiving and hemming or overfolding any die cut edges which would normally be exposed within the interior of the carton.

A further object of the present invention is to provide an opening feature which may be readily formed in a panel of the carton and overcoated to assure that the resultant carton is of a high barrier construction.

These as well as additional objects and advantages of the present invention are achieved by producing a paperboard carton blank including a first panel having side walls connected thereto by scored fold lines formed between a respective one of the side walls and a respective edge of the first panel. A second panel is provided having a side wall connected thereto by a scored fold line formed between the side wall and an edge of the second panel, with one of the side walls of the first panel and the side wall of the second panel being congruent. A seal flap is provided and extends a predetermined distance from a predetermined edge of one of the side walls of the first panel, the predetermined edge of the side wall being that edge which extends adjacent to a predetermined edge of the second panel of a carton formed from the blank. The blank also includes opposing end panels connected to each of the side walls and the first and second panels with each of the end walls having at least one die cut edge. A predetermined portion of at least one of the end panels is skived and overfolded along a fold line adjacent to the die cut edge such that no die cut edge is exposed within the carton formed of the blank. The blank also includes an opening feature defined by the predetermined edge of the second panel and regions of weakness formed in the second panel extending from the predetermined edge of the second panel for permitting access to the inside of a carton formed from the blank. The regions of weakness being formed of a pair of substantially parallel lines of weakness with at least one of the lines of weakness being a knurled line of weakness.

The above paperboard blank being use to form a carton of a high barrier construction for containing a product placed therein. The carton comprises a bottom panel, a top panel, side walls extending from the bottom panel to the top panel and overlapping end walls extending from the bottom panel to the top panel with at least one of the overlapping end walls having a predetermined edge portion positioned within an interior of the carton. A seal flap extends a predetermined distance from a predetermined edge of one of the side walls, with the predetermined edge of the side wall being that edge which extends adjacent to a predetermined edge of the top panel. An opening feature is also provided in the top panel which is defined by the predetermined edge of the top panel and regions of weakness formed in the top panel which extend from the predetermined edge of the top panel for permitting access to the interior of the carton. In order to provide a high barrier construction, a predetermined portion of the end wall adjacent the predetermined edge thereof is skived and overfolded along a fold line adjacent to the predetermined edge such that no die cut portion of the predetermined edge of the end wall is exposed within the interior of the carton.

The regions of weakness are formed in the carton by first forming a first line of weakness in a first surface of the paperboard blank, then forming a second line of weakness in an opposing surface of the paperboard blank substantially parallel to and offset from the first line of weakness thus defining the region of weakness therebetween with at least one of the lines of weakness being a knurled line of weakness.

These as well as additional advantages of the present invention will become apparent from the following detailed description of the invention with reference to the several figures.

DETAILED DESCRIPTION OF THE PREFERRED EMBODIMENT

Figure 1:
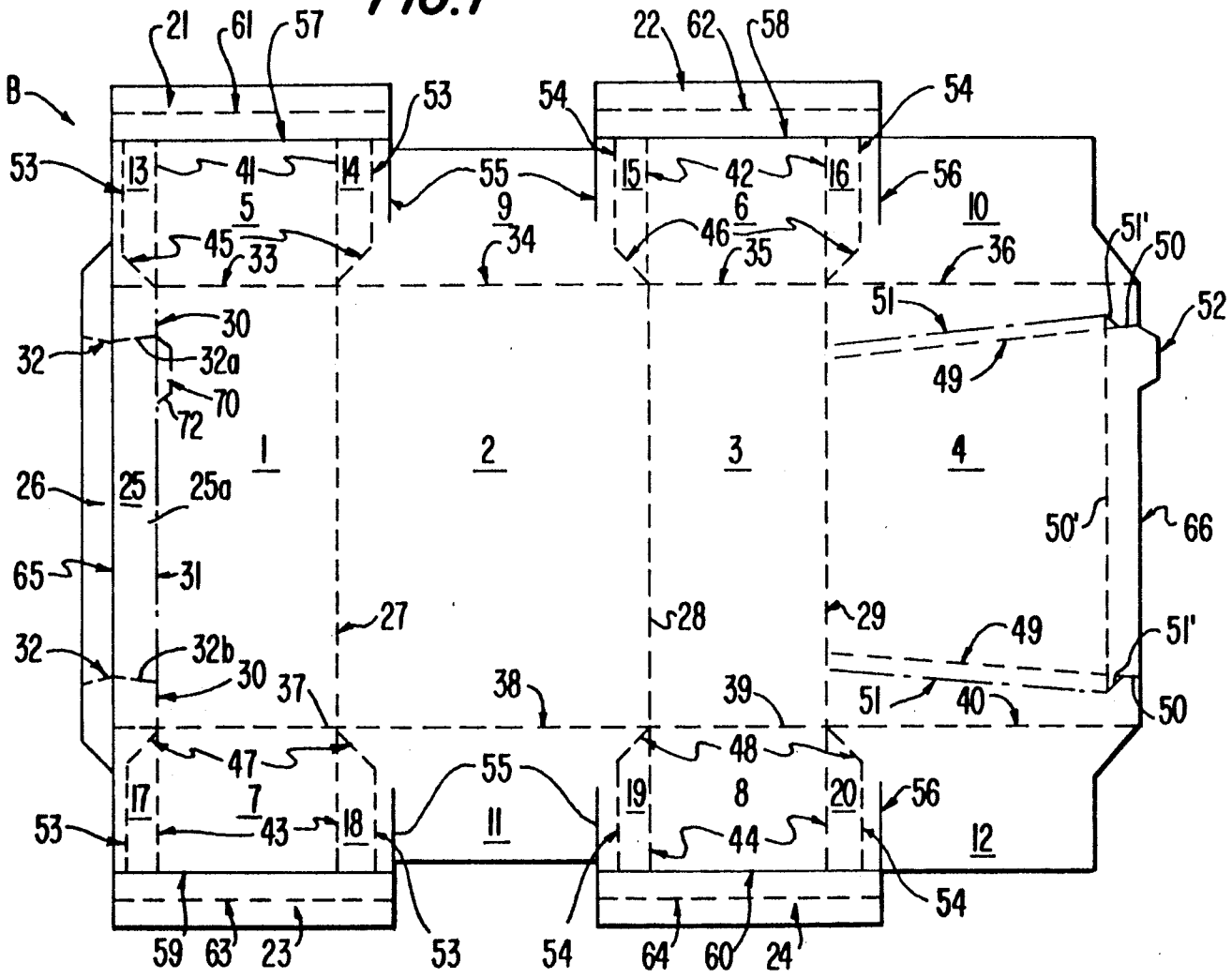
FIG. 1 is ,a, plan view of the carton blank used in forming the carton in accordance with the preferred embodiment of the present invention.

Referring now to FIG. 1, the paperboard carton blank B is illustrated and includes a front panel 1, bottom panel 2, back panel 3 and top panel 4. The front and back panels 1 and 3 are flanked by underlying end panels 5 and 7, and 6 and 8, respectively. The bottom and top panels 2 and 4 are flanked by outside end panels 9 and 11, and 10 and 12, respectively. The underlying end panels 5, 6, 7 and 8 each include web panels 13, 14, 15, 16, 17, 18, 19 and 20 extending from each side thereof. Attached to the underlying end panels 5, 6, 7 and 8 and the web panels are extension 21, 22, 23 and 24 of the panels 5, 6, 7 and 8, respectively. Attached to front panel 1 is a side seam 25 and attached to the side seam is an extension 26, the significance thereof will be set forth in greater detail hereinbelow. The paperboard material is preferably overcoated with polyethylene or other similar barrier materials. These materials may also be chosen to be suitable in a microwave oven. Those skilled in the art will certainly appreciate that the specific coating selected will be directly dependent upon the intended use of the resulting carton. The blank B may further include a metallic coating.

The carton blank B additionally has main body crease score lines 27 between the front panel 1 and bottom panel 2, 28 between bottom panel 2 and back panel 3, and 29 between back panel 3 and top panel 4. The front panel 1 further includes crease scores 30 and outside partial cut score 31 which is cut to a depth of 50% of the paperboard thickness forming the hinged joint between the front panel 1 and the side seam 25. The extension 26, which is an extension of the heat seal side seam 25, further includes through knife cuts 32. Partial cut scores 32*a* and 32*b* are provided as continuations of the through knife cuts 32 and extend from the extension 26 to the partial cut score 31. In doing so, a release area 25*a* is formed in the side seam 25. The significance of such release area will be described in greater detail herein below.

The front, bottom, back and top panels are divided from the end panels by crease score lines 33–40 as illustrated. Underlying panels 5, 6, 7 and 8 include web folding crease score lines 41, 42, 43 and 44 which are an extension of crease score lines 27, 28, 29 and 30. Also diagonal web crease score lines 45, 46, 47 and 48 are provided.

The top panel 4 includes an opening feature formed of crease score lines or partial cut score lines 49 and outside partial cut score lines 51. These crease score lines and partial cut score lines combine to form the opening feature further for gaining access to the contents of the carton of the present invention. Such an opening feature is as set forth in U.S. Pat. No. 4,951,824 issued to Kuchenbecker and assigned to the assignee of the present invention the content of which is hereby incorporated herein by reference. The opening feature includes a lift tab 52 which is preferred over the outside tear flap of U.S. Pat. No. 4,951,824 for the reasons discussed in copending application Ser. No. 616,357 filed Nov. 12, 1990, the content of which is hereby incorporated herein by reference. Lead-in through cuts 50 which are cut through the entire thickness of the paperboard material are further provided to aid in the initiation of the ply separation. These through cuts 50 extend substantially colinear with the lines 49. The lines of weakness 51 extend substantially parallel to the lines of weakness 49 and include a convergent portion 51' which extends at an angle from the lines of weakness 51 toward the lines of weakness 49 and intersects the lines of weakness 49 at the termination of the lead-in through cuts 50. A further crease score fold line 50' may be provided to extend between the regions of weakness formed by the respective pairs of lines of weakness 49, 51 for facilitating reclosure of the carton. This being set forth in greater detail in the above-mentioned copending application.

There is an additional crease score on the web panels formed in the underlying end panels 5, 6, 7 and 8 and are identified by reference numerals 53 and 54. The web panel extensions 13–20 are separated from the respective adjacent outside end panels 9, 10, 11 and 12 by vertical cut lines 55 and 56. The remaining outer periphery of the blank is separated from the sheet of paperboard material by knife cut lines.

After the carton blank is die cut, it is necessary to skive and hem or overfold certain areas of the blank to eliminate the presence of any raw edges which would exist in the inside of the carton which would allow the transfer of moisture or other liquids or gases between the carton contents and the environment. The extensions 21, 22, 23 and 24 of the underlying end panels 5, 6, 7 and 8 are skived on the outside to a width that will end at lines 57, 58, 59 and 60. Skiving is carried out in a manner similar to that of routing wood when woodworking. Herein, a cutting blade removes a predetermined thickness of the paperboard material at predetermined area. Once skived, the panels 21, 22, 23 and 24 receive an application of adhesive and subsequently are folded to the outside on crease score lines 61, 62, 63 and 64, respectively. The depth of the skive can vary, however, it has been found that when using a paperboard material having a caliper or thickness of 0.014 inches, a skive having a depth of 0.009 is preferred for control of the remaining thickness of 0.005 inches. The significance of such is set forth in greater detail with reference to FIG. 6. The extension panel 26 of side seam 25 is also skived on the outside thereof, receives an application of adhesive and is folded along crease score line 65 such that it will be bonded to the outside of side seam 25.

Figure 5:
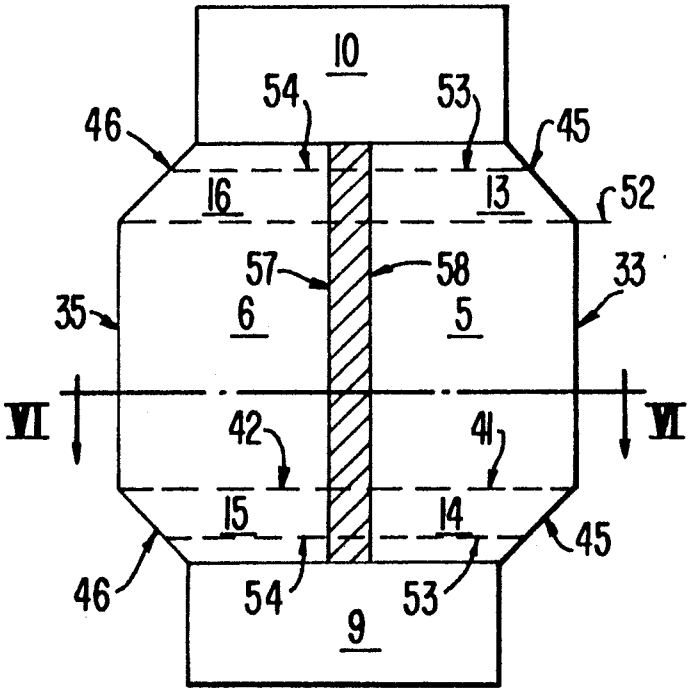
FIG. 5 is an end view of a partially erected carton showing underlying end panels and an overlapping skived and hemmed area after sealing.

The carton being properly prepared is now ready to be heat seal side seamed wherein heat is applied to the inside area of the top panel 4 along cut line 66 and to the outside of side seam 25. At the same time the carton is folded on crease score lines 27 and 29, thus when brought together and pressure is applied in that area, the side seaming is completed. It should be noted that in each instance where heat sealing is carried out, the same areas may be alternatively sealed by adhesive or similar known means of adhering coated paperboard material. At the point of packaging and after the carton is formed into a tubular shape, the underlying end panels 5 and 6 are folded inward 90° on crease score lines 33 and 35 over a thin metal fixture that will act as a support or back up to allow pressure to be concentrated in the width of the overlap as illustrated by the cross hatched area shown in FIG. 5. As the carton travels through the packaging line, the carton is withdrawn from the thin metal fixture and the web panels 13, 14, 15 and 16 can be sealed to the inside of the outside end panels 9 and 10. In order to insure the maximum pressure and seal, the sealing head is constructed having a raised ridge or pressure points which would extend over the full length of both underlying end panels and cooperating with the score lines 53 and 54 shown in FIG. 5. These pressure points must compress the paperboard in order to effect a proper seal. As mentioned above, in order to increase the effectiveness of the pressure points, the crease scores 53 and 54 are formed during die cutting. The ridges of the heat seal head will consequently register with the crease score lines 53, 54 which will allow for greater contact in the areas outside of the pressure point area.

To reduce any excessive thickness of paperboard material which may effect pressure point contact, the diagonal crease score lines 45, 46, 47 and 48 are terminated short of intersecting the vertical cut lines 55 and 56, thus, eliminating any raised portion of the crease. A conduction heat sealing method of activating the heat sealable surfaces is used for effecting the sealing of the web panels 13–20 to the inside of the outside end panels 9, 10, 11 and 12.

The crease score lines 53, 54 also serve an additional purpose. The distance between where the diagonal crease score lines 45, 46, 47, 48 terminate and the vertical knife cuts 55, 56 begin, may include an additional knife cut (not shown). After the underlying end panels 5, 6, 7 and 8 have been folded inward and the center skived and hemmed area has been sealed, the advance pressure point crease score lines 53, 54 may also act as a hinge line. These hinge lines can then be folded back to open up the area between the hinge line 41–44 and the knife cuts 55 and 56 and the outside end panels 9, 10, 11 and 12. This will allow exposure of both face-to-face surfaces for activating the heat seal coating by use of a gas flame or electric heat. These surfaces will subsequently be returned for face-to-face contact and pressure point registration with the ridges of the heat seal head.

Figure 6:
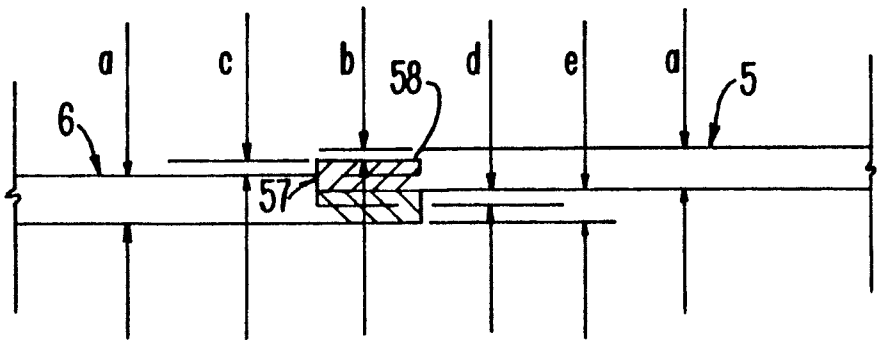
FIG. 6 is a cross-sectional view taken along line VI—VI of FIG. 5 showing the skived and hemmed area after it has been folded onto itself.

With reference now to FIG. 6, the extension panels 21, 22, 23 and 24 are skived and hemmed as previously mentioned. The hemming eliminates the raw edges. Moreover, the combination of both has in effect reduced the area of paperboard at which there would generally be an offset of 0.014 to an offset of only 0.004. As can be seen from FIG. 6, the paperboard thickness is represented by arrows a, and the offset is represented by arrows b. An example of the various dimension when using the above-mentioned paperboard having a caliper of 0.014 inches is as follows.

a=0.014 inches
b=0.004 inches
c=0.006 inches
d=0.005 inches
e=0.010 inches

Returning now to FIGS. 2–4, it has been found that a full-length lift tab between crease score opening feature lines 49 and 50 and the cut score release area 25 extending from front panel 1 offers resistance to opening when a front-to-rear direction opening method is used. As can be seen from the figures, the lift tab area has been reduced from full-length to a small lift tab 52. This small lift tab opening allows for a cut score ply separation also in a left-to-right direction and greatly reduces the resistance to opening. This being set forth in detail in the above-mentioned copending application.

Figure 2:
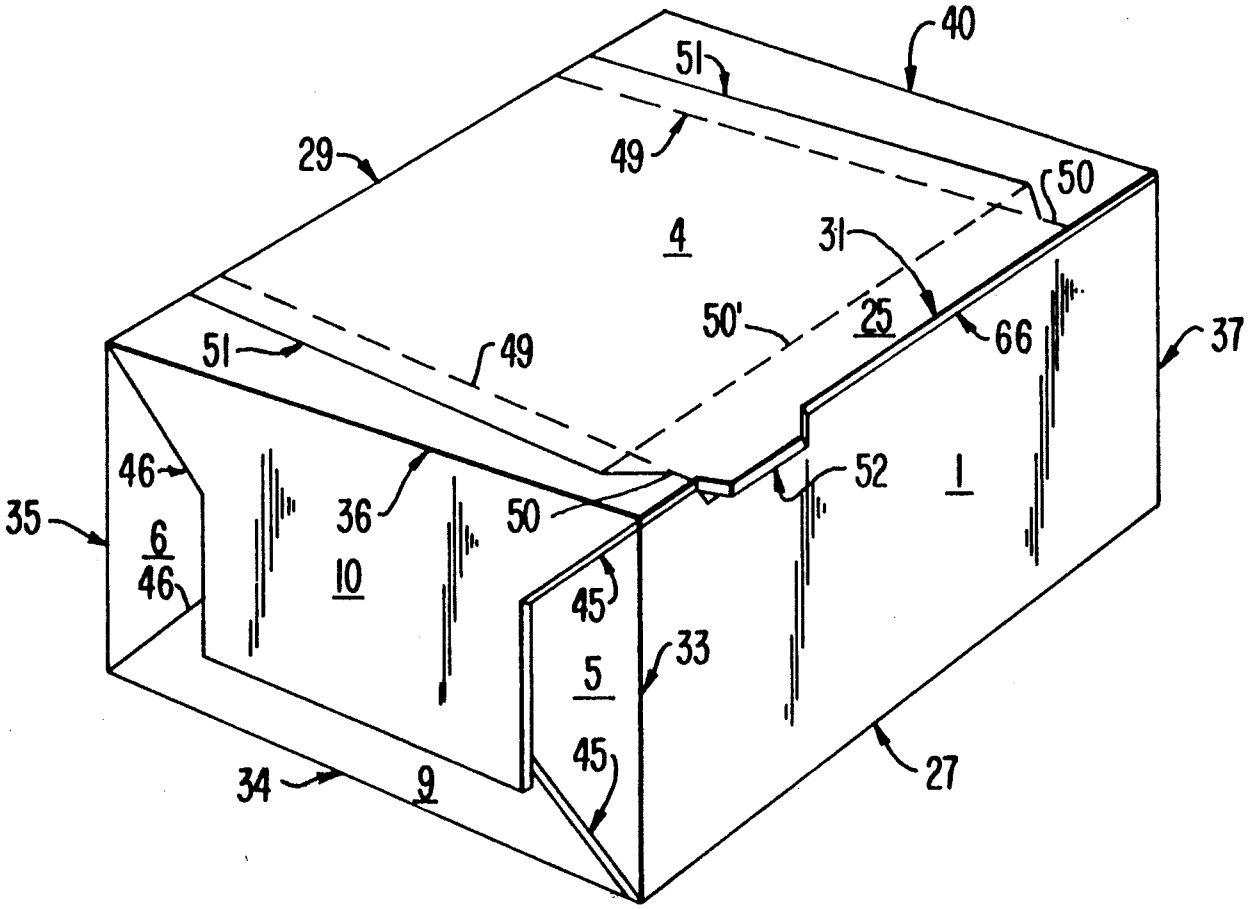
FIG. 2 is a perspective view of an erected carton in accordance with the present invention.
Figure 3:
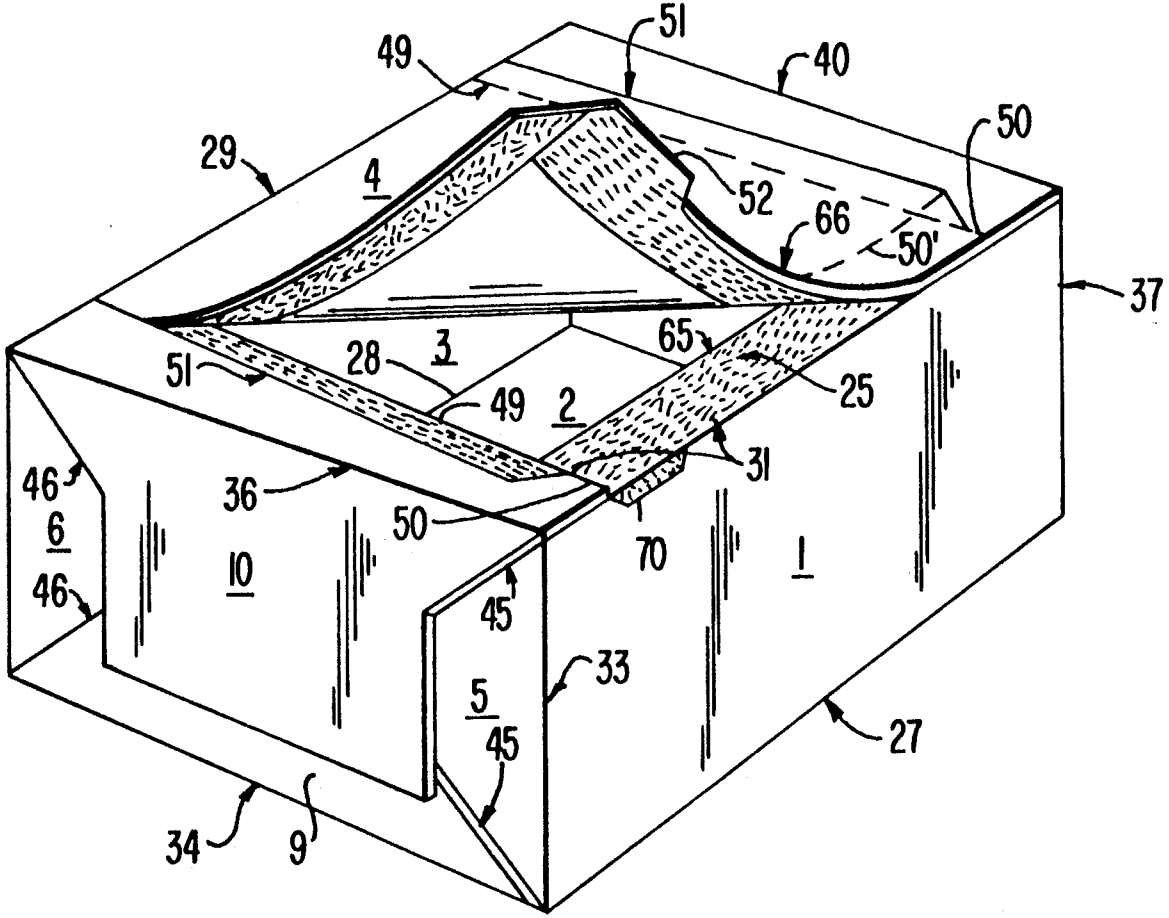
FIG. 3 is a perspective view of the carton in a partially opened condition.
Figure 4:
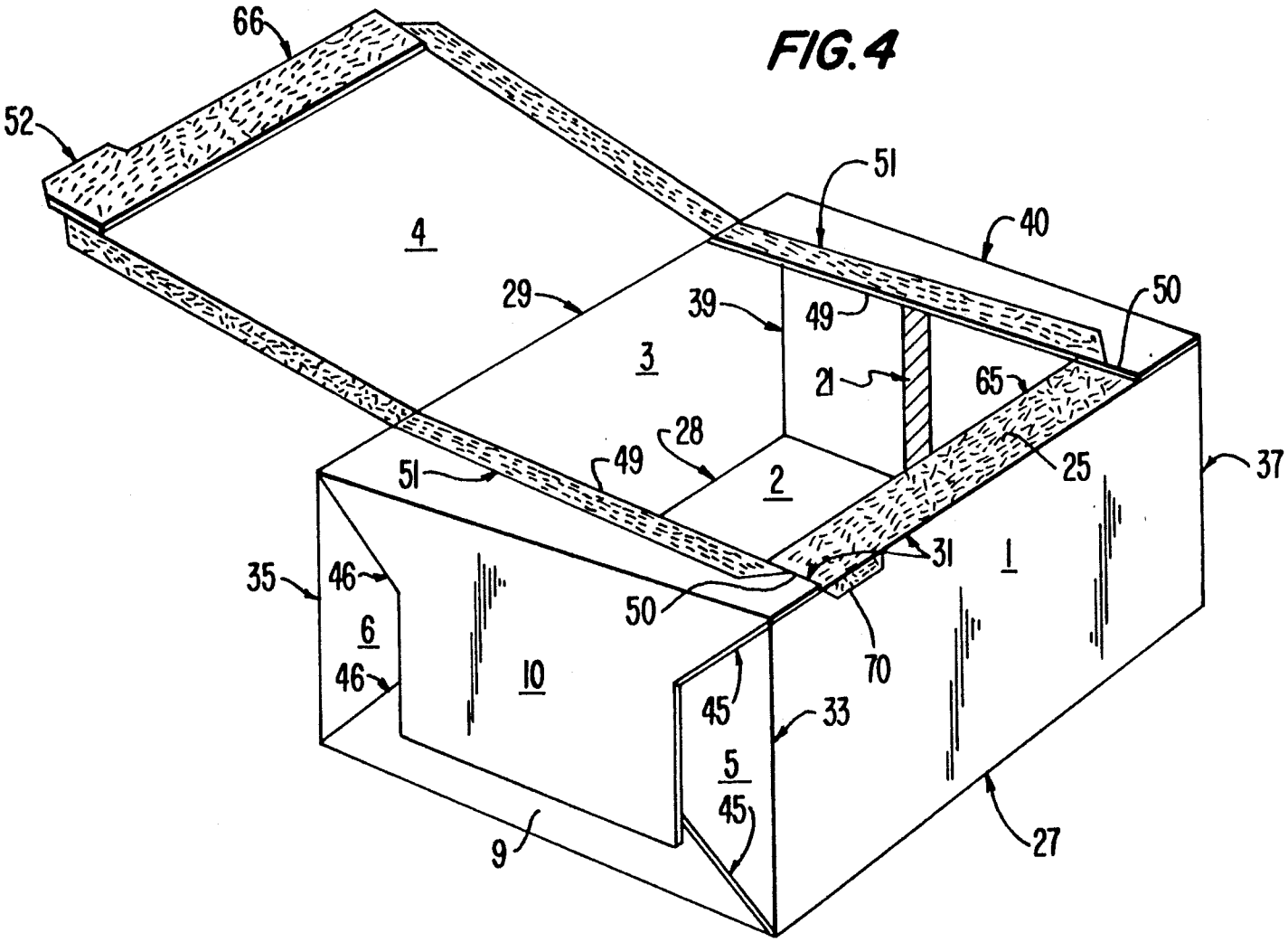
FIG. 4 is a perspective view of the carton in a fully opened condition.

Another significance of the left-to-right opening is that if a front-to-rear opening direction were used, score line 65 of the skived area 26 would have to be perforated to provide a break away of the skived and hemmed area at the time the ply separation of cut scored area 25 reaches line 65. The perforation with its alternate knife cuts, however, would provide entry of moisture vapor or other gases into the carton detrimentally affecting the performance of the carton. For that reason line 65 is an uncut fold line of which the fold is controlled by the skived offset at that point. Additionally, the left-to-right opening direction will cause the remaining thickness of 0.005 that has been hemmed onto the outside of the side seam 25 and over a release area 66 to tear easily along line 65 as shown in FIG. 3. A front-to-rear action of the crease score line 49 and cut score line 51 will take place and when the ply separation of cut scored area 25 reaches the second crease score 49 and cut score 51, the same front-to-rear opening action will take place. These sequential opening steps being illustrated in FIGS. 2–4. The carton is now fully opened as shown in FIG. 4 for either product consumption or removal of the item packaged. Additionally provided in the front panel 1 is a release area 70 which is formed by a partial cut score line 72 corresponding to the lift tab 52 such that when the carton is erected, the lift tab is permitted to extend from the top panel 4 as illustrated in FIG. 2. The significance of this release area is set forth in greater detail in the above-mentioned copending application.

Figure 7:
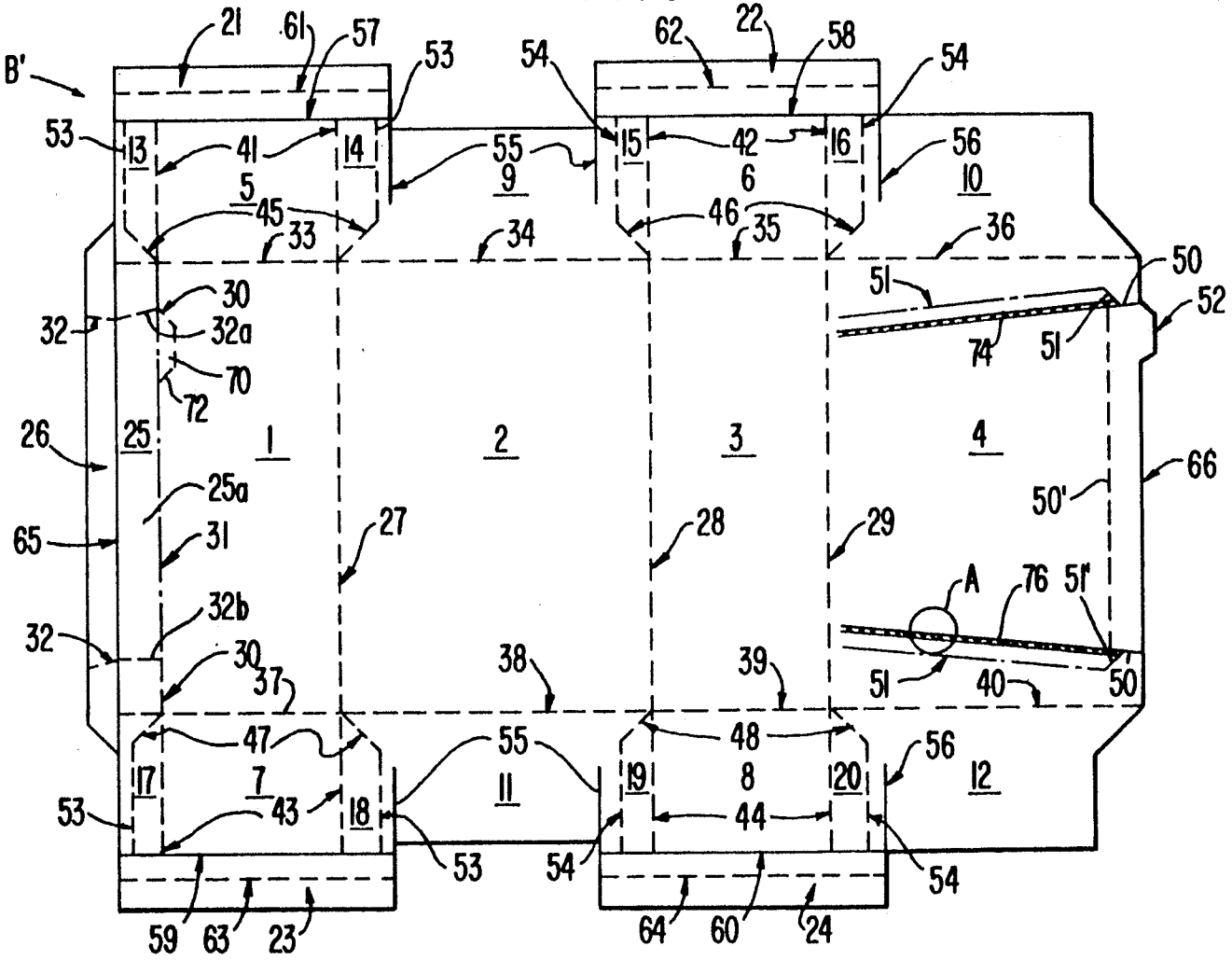
FIG. 7 is a plan view of the carton blank in accordance with an alternative embodiment of the present invention.
Figure 8:
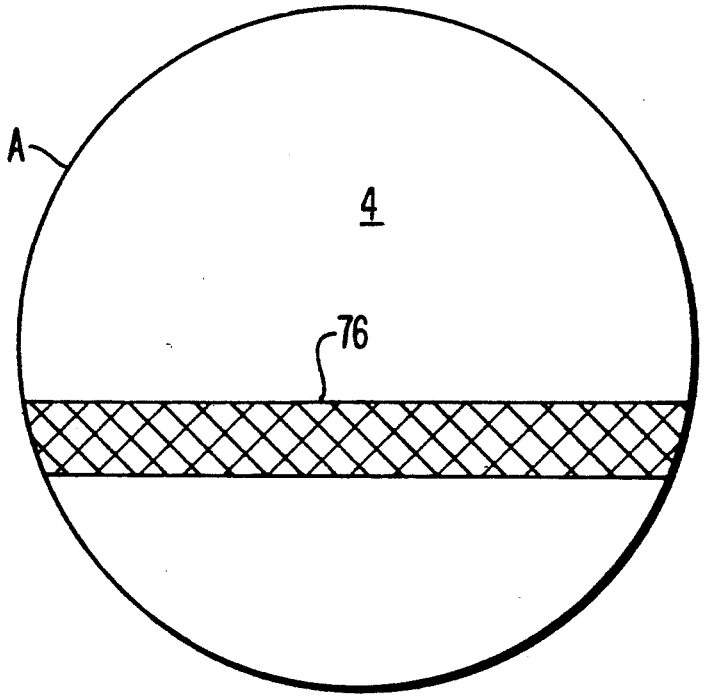
FIG. 8 is an expanded view of the portion A of FIG. 7.

Referring now to FIG. 7, the blank B′ is illustrated and is essentially identical to that of blank B set forth in FIG. 1 with the exception of the particular opening feature formed in the top panel 4. Therefore, like structures are referenced by like numerals to that of FIG. 1. When forming a carton of the blank illustrated in FIG. 1, it is necessary to overcoat the inside partially cut score line of weakness in order to maintain the high barrier nature of the formed carton. However, because the partially cut score line is a thin single cut line, often the overcoat material, generally a polymer material, may not sufficiently fill the entire partially cut score line, thus resulting in an ineffective barrier between the contents and the environment. In order to overcome the foregoing, knurled lines of weakness 74 and 76 may be provided, the knurled line of weakness 76 being shown in greater detail in FIG. 8.

The knurled lines of weakness are formed by pressing a metal plate 78 having a raised surface or surfaces in the form of a knurl pattern on the top area of the raised surface. In contrast to the aforementioned thin, partially cut score lines of weakness, the knurled lines of weakness 74 and 76 are relatively wide and, consequently, when overcoated, the reservoir formed by the wide knurled line will readily receive the overcoat material therein. The knurled lines of weakness 74 and 76 are formed in accordance with a preferred embodiment of the invention by first forming a coarse diamond pattern in the knurling plate by a coarse diamond knurling tool (not shown) and, subsequently, forming a similar but medium diamond pattern in the same knurling plate by a medium diamond knurling tool (not shown). In doing so, when the knurling plate is pressed into the blank simultaneously with the formation of the other crease score lines and cut score lines, the fibers of the paperboard material are sufficiently broken down by the combination of the coarse diamond knurl pattern and the medium diamond knurl pattern such that when an opening force is applied to the lift tab 52 the paperboard material will readily separate and begin a ply separation in the area between the knurled lines of weakness 74 and 76 and the respective partially cut lines of weakness 51.

While FIG. 7 illustrates the knurled lines of weakness formed only on the inside of the paperboard blank, the outer lines of weakness shown in FIG. 7 as partially cut lines of weakness 51 may be formed in a similar manner to that of knurled lines of weakness 74 and 76. Accordingly, the opening feature of the carton may include regions of weakness wherein either one of or both the inner and outer lines of weakness are knurled lines of weakness formed in accordance with the foregoing procedure.

As can be seen from the foregoing, a carton formed in accordance with the present invention will provide a barrier between the contents of the carton and the environment, thus removing the possibility of contamination of the contents within the carton or any leakage of the contents of the carton. Moreover, by forming the carton in accordance with the present invention, a reliable opening feature is provided which is capable of being opened by the consumer with ease and which will resist the infiltration of moisture while not retarding the structural integrity of the carton when opened.

While the present invention has been described with reference to the preferred embodiment, it will be appreciated by those skilled in the art that the invention may be practiced otherwise then as specifically described herein without departing from the spirit and scope of the invention. It is, therefore, to be understood that the spirit and scope of the invention be limited only by the appended claims.

What is claimed is:

1. A method of forming a ply-separation region in a paperboard blank for facilitating the separation of layers of the paperboard blank comprising:

forming a first line of weakness in a first surface of the paperboard material; and forming a second line of weakness in an opposing surface of the paperboard material substantially parallel to and laterally offset along a length of the paperboard material from said first line of weakness thereby defining a ply separation region therebetween;

wherein at least one of said lines of weakness is a knurled line of weakness.

2. The method as defined in claim 1, wherein both said first and second lines of weakness are knurled lines of weakness.

3. The method as defined in claim 1, further comprising the step of forming the paperboard blank into a carton, wherein the region of weakness forms an opening means in a panel of the carton for gaining access to an interior of the carton.

4. The method as defined in claim 3, further comprising the step of forming a pair of ply-separation regions in said panel of the carton, wherein said pair of ply-separation regions form said opening means.

* * * * *